US005551869A

United States Patent [19]

Brais et al.

[11] Patent Number: 5,551,869

[45] Date of Patent: Sep. 3, 1996

[54] GAS STAGED BURNER

[75] Inventors: Normand Brais, Rosemere; Louis-Michel Malouin, Montréal; Jacques Martrés, Hampstead, all of Canada

[73] Assignee: Brais, Martres et Associés Inc., Montréal, Canada

[21] Appl. No.: 399,538

[22] Filed: Mar. 7, 1995

[51] Int. Cl.[6] ..... F23Q 9/00

[52] U.S. Cl. ..... 431/285; 431/278; 431/349; 431/353

[58] Field of Search ..... 431/11, 1, 285, 431/278, 279, 286, 353, 349, 247

[56] References Cited

U.S. PATENT DOCUMENTS

| | | | |
|---|---|---|---|
| 4,597,733 | 7/1986 | Dean et al. | 431/285 |
| 5,195,885 | 3/1993 | Medina | 431/353 |
| 5,318,436 | 6/1994 | Colket, III et al. | 431/285 |

FOREIGN PATENT DOCUMENTS

| | | | |
|---|---|---|---|
| 885706 | 11/1981 | U.S.S.R. | 431/1 |

*Primary Examiner*—James C. Yeung
*Attorney, Agent, or Firm*—ROBIC

[57] ABSTRACT

A burner is provided for heating a stream of combustion supporting gas, like air. The burner has a main feed pipe extending across the stream of combustion supporting gas. The main feed pipe has an inlet for receiving a fuel gas from a fuel gas source, and at least one outlet for producing a main jet of fuel gas substantially in the direction of the stream. The burner also has two parallel auxiliary feed pipes extending across the stream of combustion supporting gas, at a predetermined distance downstream from the main pipe and on each side of the main jet. Each of the auxiliary feed pipes has an inlet for receiving fuel gas from the fuel gas source, and at least one outlet for producing an auxiliary jet of fuel gas in the direction of the stream. The burner further has two bluff-body devices in front of the outlets of both the auxiliary feed pipes respectively. Each of the bluff-body devices has a hole aligned with each corresponding outlet in order to produce a stable pilot flame adjacent to the main jet of fuel gas for ignition thereof. This burner is useful since it allows for a better mixing of the fuel gas with the stream of combustion supporting gas. Such in turn allows for a better combustion of the fuel gas and, hence, a reduction of pollutant emissions.

12 Claims, 2 Drawing Sheets

GAS STAGED BURNER

BACKGROUND OF THE INVENTION

1. Field of the Invention

The present invention relates to a burner particularly well adapted for use in a duct, such as a ventilation duct, for heating a stream of combustion supporting gas, like air.

The invention also relates to a process for heating a stream of combustion supporting gas.

2. Description of Related Art

"Direct-fired air heating" basically consists in using combustion products diluted in air for a heating application, such as the heating of a warehouse or some drying operation. Gaseous fuels which do not contain sulfur are particularly useful for this type of heating.

To proceed to such direct-fired air heating, a special type of burner has been developed, which is called "duct burner" because it consists of a piece of equipment that may be placed directly in a ventilation duct.

The conventional duct burners comprise a feed pipe with an integral baffle, called "bluff-body", which extends across a stream of air.

The feed pipe has a plurality of outlets for injecting a fuel gas in the direction of the stream. The first purpose of the bluff-body which is located upstream of the outlets, is to create a reverse flow in its center and a low velocity zone on both sides of the flame to stabilize the same. The second purpose of the bluff-body is to generate the turbulent energy required to ensure a complete mixing of the fuel gas with air. The problem with such a type of burner is that the stabilization of the flame and the mixing of the fuel gas are two opposing mechanisms. Increasing the size of the bluff-body in order to improve the flame stability results in a decrease in the mixing rate and vice versa.

The flame generated downstream of the bluff-body is intense, thus exposing the bluff-body to high temperatures. In order to sustain high temperatures, the bluff-body has to be made of heat resisting alloy blocks which substantially increases the cost of the burner. In order to minimize the costs, duct burner manufacturers have increased as much as possible the linear power of their burner by using very large bluff-bodies. The linear power is the amount of heat per unit length released by the burner. For example, a conventional duct burner releases around 5 MMBTU per hour per feet. Pursuing this trend of increasing the dimension of the bluff-body has brought major drawbacks. First of all, mixing capabilities are greatly diminished which results in a much longer flame that can be as long as 3 to 4 meters. A longer flame requires a longer combustion chamber which increases the overall cost of the application. Also, a reduced mixing rate can generate unacceptable levels of carbon monoxide emissions. Furthermore, increasing the dimension of the bluff-body also increases the pressure drop across the burner. The fan horsepower requirement increases as the dimension of the bluff-body increases. In addition, increasing the linear power tends to increase nitrogen oxide emissions.

In order to improve the duct burner's mixing rate, it appears imperative to reduce the size of the bluff-body while maintaining an efficient stabilization. A better mixing of the gaseous fuel with air allows for a better combustion and hence, a reduction of pollutant emissions.

OBJECTS OF THE INVENTION

It is therefore an object of the present invention to provide a process and a burner for heating a stream of combustion supporting gas, in which the mixing rate is increased without affecting flame stability, and the flame stability is improved without jeopardizing the mixing rate.

Another object of the present invention is to provide such a process and burner, in which the cost of the application is reduced, while the emissions of carbon monoxide as well as nitrogen oxide are also reduced.

SUMMARY OF THE INVENTION

In accordance with the present invention, these objects are achieved with a burner for heating a stream of combustion supporting gas, said burner comprising:

a main feed pipe extending across the stream of combustion supporting gas, said main feed pipe having an inlet for receiving a fuel gas from a fuel gas source, and at least one outlet for producing a main jet of fuel gas substantially in the direction of said stream;

two parallel auxiliary feed pipes extending across the stream of combustion supporting gas, at a predetermined distance downstream from said main pipe and respectively on each side of said main jet, each of said auxiliary feed pipes having an inlet for receiving fuel gas from said fuel gas source, and at least one outlet for producing an auxiliary jet of fuel in the direction of said stream; and two bluff-body devices in front of the outlets of both said auxiliary feed pipes, respectively each of said bluff-body devices having a hole aligned with each corresponding outlet of the auxiliary feed pipes for receiving a portion of the secondary jet from said corresponding outlets in order to produce a stable pilot flame adjacent the main jet of fuel for ignition thereof.

In accordance with the invention, there is also provided a process for heating a stream of combustion supporting gas, said process comprising:

injecting a main jet of fuel gas substantially in the direction of the stream of combustion supporting gas; and igniting said fuel gas by two stabilized pilot flames located on each side of said main jet of fuel gas and at a predetermined distance downstream from the injection of said fuel gas.

The present invention is particularly useful since it allows for a better mixing of the fuel gas with the stream of combustion supporting gas. Such in turn allows for a better combustion of the fuel gas and, hence, a reduction of pollutant emissions:.

BRIEF DESCRIPTION OF THE DRAWINGS

In order to impart full understanding of the manner in which the above mentioned objects are achieved in accordance with the present invention, a detailed description of a preferred embodiment thereof will now be given with reference to the accompanying drawings wherein.

DETAILED DESCRIPTION OF THE INVENTION

Figure 1:
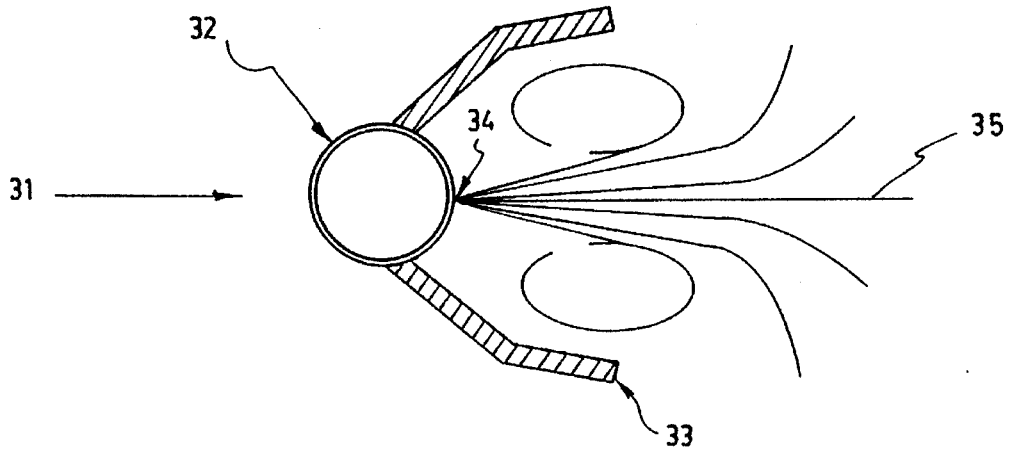
FIG. 1 (PRIOR ART)
FIG. 1 shows a side elevation view of a prior art burner.

In the following description and in the drawings, like reference numerals designate like or corresponding parts.

Referring first to FIG. 1, there is shown a prior art duct burner for heating a stream of air 31. The duct burner comprises a main feed pipe 32 having a main outlet 34 for producing a main jet 35 of fuel gas. The main feed pipe 32 is provided with an integrated bluff-body 33 that creates a velocity zone to stabilize the flame. The bluff-body 33 also generates the turbulent energy required to ensure the complete mixing of the fuel gas with air. As mentioned hereinabove, the problem With this burner is that the stabilization of the flame and the mixing of the fuel gas are two opposing mechanisms. Increasing the size of the bluff-body 33 in order to improve flame stability results in a decrease in the mixing rate and vice versa.

In order to improve the duct burner's mixing rate, the present invention proposes to reduce the size of the bluff-body 33 while maintaining an efficient stabilization. A better mixing of the gaseous fuel with air allows for a better combustion and hence, a reduction of pollutant emissions. The only way to improve the mixing mechanism without affecting the stabilization is to segregate the mixing from the stabilization mechanism, which is the specific purpose of the present invention.

Figure 2:
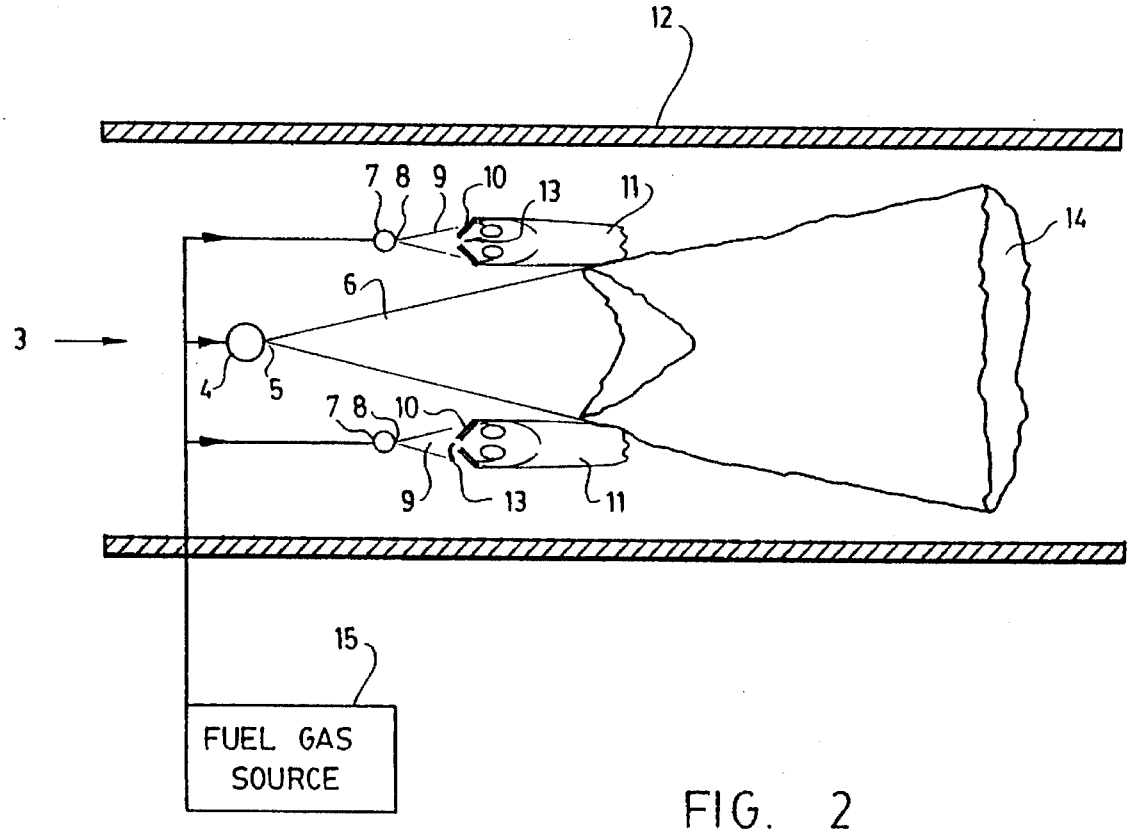
FIG. 2 shows a side elevation view of a burner, according to the present, invention, in operation.

Referring now to FIG. 2, there is shown a burner according to the present invention that is located inside a duct 12 for heating a stream of combustion supporting gas 3. The burner comprises a main feed pipe 4 that extends across the stream of combustion supporting gas 3. The main feed pipe 4 has an inlet (not shown) for receiving fuel gas from a fuel gas source 15, and an outlet 5 for producing a main jet 6 of fuel gas substantially in the direction of the stream 3. The burner also has two parallel auxiliary feed pipes 7 that extend across the stream of combustion supporting gas 3, which are located at a predetermined distance downstream from the main pipe 4 and on each side of the main jet 6. Each of the auxiliary feed pipes 7 has an inlet (not shown) for receiving fuel gas from the fuel gas source 15, and an outlet 8 for producing an auxiliary jet 9 of fuel gas substantially in the direction of the stream 3. The burner further has two bluff-body devices 10 downstream of the outlet 8 of both auxiliary feed pipes 7, respectively. Each bluff-body device 10 has a hole 13 aligned with each corresponding outlet 8 of the auxiliary feed pipes 7, for receiving a portion of the auxiliary jet 9 from the auxiliary feed pipe 9 in order to produce a stable pilot flame 11 adjacent to the main jet 6 of fuel gas for ignition thereof.

The proposed mixing mechanism is based on free jet theory. A single fluid jet injected into ambient air creates a low pressure zone that draws in the air and mixes with it. Up to 85% of the fuel gas is injected at this stage. The fuel gas injection can be accomplished by one or several rows of outlets. The remainder of the fuel gas is burned in a second stage to ignite the mixture and therefore stabilize the main flame. The pilot flames are stabilized using bluff-body devices. Free jet theory shows that the mixing length depends on the size of the outlet of the feed pipe. A smaller outlet diameter gives a shorter mixing length. The mixing energy generated by the momentum flux of the jet can be orders of magnitude greater than the mixing energy created by the pressure drop of a large bluff-body used in actual commercial duct burners. In fact, exploitation of the fuel jet momentum to accomplish mixing has been seldom used previously and is an important feature of the proposed invention. This effect provides a much better mixing which decreases the flame length considerably.

The stabilization mechanism proposed in accordance with the present invention is totally independent from the mixing process and is accomplished by two pilot flames 11 located on each side of the main jet 6 at a predetermined downstream position allowing the main jet to be mixed at a suitable air/fuel gas ratio. If the air/fuel gas ratio is too lean, high CO emissions will occur, if the mixture is too rich, NOx emission will increase. These pilot flames 11 are stabilized by two small bluff-body 10 devices. The dimensions of the bluff-body 10 device are largely reduced given that only a minor fraction of the fuel gas is used to sustain the main flame 14.

Figure 3:
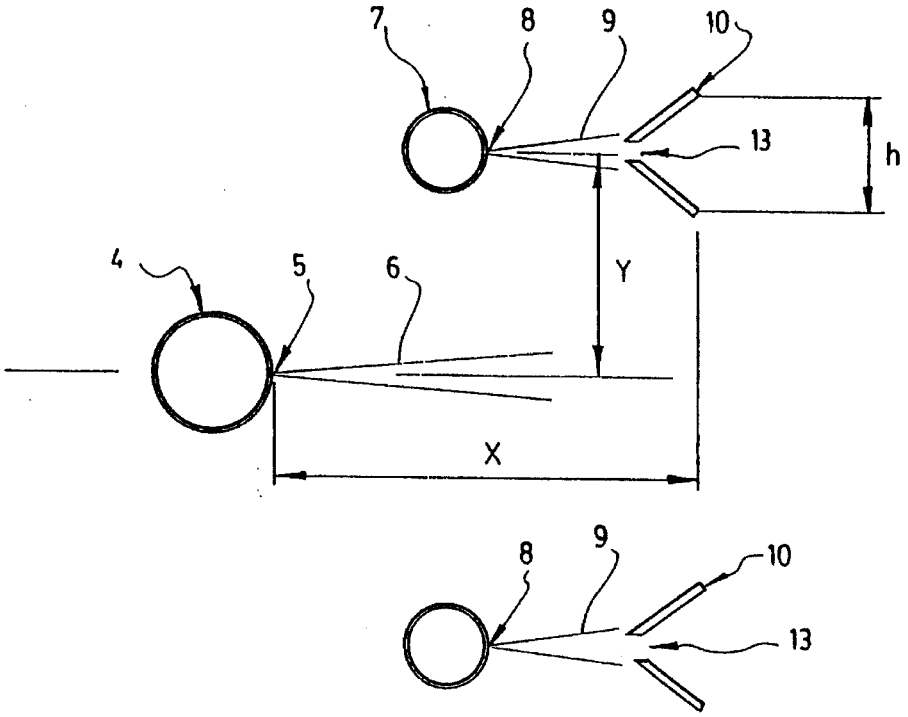
FIG. 3 shows a schematic diagram of a burner according to the present invention.
Figure 4:
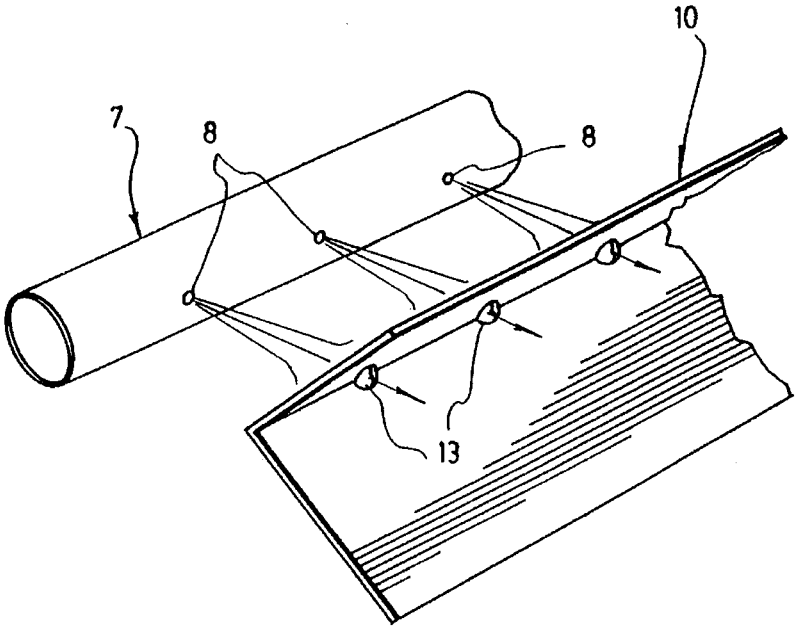
FIG. 4 shows a perspective view of a bluff-body in front of a secondary feed pipe, in operation, according to the present invention.

Experimental testing has shown that the results concurred with the applied theory. The burner that was tested is schematically illustrated in FIG. 3. It was mounted in a duct of about 3 ft wide and 1.5 ft high. The main pipe had a diameter of 1 inch and a pressure supply of 4 psig. The main pipe also had 42 main outlets 5 spaced ¼ inch apart, each main outlet 5 having a diameter of 1/16 inch. Each auxiliary pipe 7 had a diameter of ⅜ inch and a pressure supply of 1 psig. Each auxiliary pipe 7 also had 7 auxiliary outlets 8 spaced 1 11/16 inches apart, each outlet 8 having a diameter 1/16 inch. The distance x between the main outlet 5 and the bluff-body device 10 was 1 11/16 inches. The vertical distance y between the auxiliary outlet 8 and the main outlet was 1 13/16 inches.

The burner resulted in a faster and more homogeneous mixing, the flame length decreased and the NOx and CO emissions decreased considerably as well. The flame length has been reduced by 50%, to 5 feet and subsequent testing results have shown an achievable flame length of 3.5 feet. The NOx emissions have been reduced to 0.04 lb/MMBTU which corresponds to a 45% reduction. The CO emissions have been reduced to 0.03 lb/MMBTU which also corresponds to a 40% reduction compared to the best duct burners on the market.

In this conviction, it is worth mentioning that the combustion of a hydrocarbon based gaseous fuel in air produces high temperature combustion products. Molecular nitrogen from air can decompose in these conditions and react with oxygen and form nitrogen oxides (known as thermal NOx). Thermal NOx formation increases sharply with temperature but also depends upon available oxygen, and residence time of the nitrogen at high temperature.

In a duct burner, air enters at a temperature of 20° C. The temperature rises rapidly in the combustion zone situated downstream of the stabilizer and can potentially reach 2000° C. Then, by dilution, the temperature decreases to reach the desired final stream temperature. The rate of temperature reduction depends on the mixing capabilities of the duct burner to dilute the combustion products in the air stream.

Generation of NOx occurs at temperatures of 1500° C. and above. Therefore, it is desirable to rapidly dilute the hot combustion products with air so that the residence time at temperatures greater than 500° C. is minimized. Since the ignition temperature of natural gas is about 600° C., it is quite possible to achieve a complete combustion within this temperature range (600° to 1500° C.) and thus avoid excessive NOx formation.

Gaseous fuels not containing sulfur mainly produce pollutants such as NOx and carbon monoxide (CO). The release of these pollutants is a good indicator of the performance of a duct burner.

CO is a consequence of incomplete combustion of the gaseous fuel.

Conventional duct burners have reached an upper limit where the dimension of the bluff-body has been fully optimized for performance versus the cost. The best available duct burner typically emits 0.07 lb/MMBTU of NOx and 0.05 lb/MMBTU of CO. The flame length is about 10 feet.

When mixing of the fuel and air is not properly accomplished, even when the global air/fuel gas ratio is sufficient, local air/fuel gas ratios and temperatures can be insufficient. This produces an incomplete combustion which produces unburned fuel such as CO. Another cause of CO emissions is when an excessive amount of cold air quenches the flame, quickly reducing its temperature below that of ignition. This stops the Combustion process. Due to the nature of their application duct burners normally operate with a very high level Of excess air. It is therefore very important to have an efficient and rapid mixing of the fuel with air and to maintain a temperature that allows complete combustion in order to avoid CO generation. However, it must be kept in mind that excessive temperatures will yield unacceptable NOx emissions. As was explained hereinabove, the duct burner according to the invention is a compromise between these two constraints and this can be classified as a "good" burner from an anti-pollution standpoint.

As can be appreciated, the duct burner according to the invention is very simple in structure and thus decreasing the costs compared to known burners. The linear power of a typical duct burner is around 5 MMBTU/hr/ft. The burner according to the present invention has a linear power of 3 MMBTU/hr/ft in order to minimize flame length and NOx formation. This indicates that one would need a burner 1.7 times longer to obtain the same amount of energy. However, the cost of the burner according to the invention is at least 10 times less than an actual commercial burner. The bluff-body of a conventional burner is made of several stainless steel blocks of about 6 inches wide. Supposing that each block costs approximately 100$, therefore a conventional burner may cost up to 250$/ft when including the outlets and the assembly.

The burner prototype that was tested consisted of three pipes and two bluff-body devices and costed about 25$ for a length of 30 inches. Hence, the linear cost was about 10$/ft.

In addition, the cost of the burner according to the present invention is largely reduced by the shortening of the flame length, since a shorter flame reduces the length of the combustion chamber and consequently the quantity of insulation or refractory material when required.

Although the present invention has been explained hereinafter by way of preferred embodiments thereof, it should be pointed out that any modifications to these preferred embodiments, within the scope of the appended claims, are not deemed to change or alter the nature and scope of the present invention.

What is claimed is:

1. A burner for heating a stream of combustion supporting gas, said burner comprising:

a main feed pipe extending across the stream of combustion supporting gas, said main feed pipe having an inlet for receiving a fuel gas from a fuel gas source, and at least one outlet for producing a main jet of fuel gas substantially in the direction of said stream;

two parallel auxiliary feed pipes extending across the stream of combustion supporting gas, at a predetermined distance downstream from said main pipe and on each side of said main jet, each of said auxiliary feed pipes having an inlet for receiving fuel gas from said fuel gas source, and at least one outlet for producing an auxiliary jet of fuel gas in the direction of said stream; and two bluff-body devices in front of the outlets of both said auxiliary feed pipes respectively, each of said bluff-body devices having a hole aligned with each corresponding outlet of the auxiliary feed pipes for receiving a portion of the auxiliary jet from said corresponding outlet in order to produce a stable pilot flame adjacent to the main jet of fuel gas for ignition thereof.

2. A burner according to claim 1, wherein:

each of said bluff-body devices is in the form of a V-shaped plate having an apex extending parallel and close to the corresponding auxiliary feed pipe.

3. A burner according to claim 2, wherein:

the main and auxiliary feed pipes comprise a plurality of said at least one outlet.

4. A burner according to claim 3 wherein:

said plurality of said at least one outlet is arranged in parallel rows.

5. A burner according to claim 3 wherein:

the main and auxiliary feed pipes and their respective outlets are sized so that the main jet that is formed contains up to eighty-five percent of the fuel gas from the fuel gas source.

6. A burner according to claim 5, wherein:

each hole of said bluff-body is sized to let pass through about one third of the fuel gas exiting from the corresponding outlet of the adjacent auxiliary feed pipe.

7. A burner according to claim 6 which is enclosed in a conduit.

8. A burner according to claim 5 which is enclosed in a conduit.

9. A burner according to claim 3 which is enclosed in a conduit.

10. A burner according to claim 1 wherein:

the main and auxiliary feed pipes and their respective outlets are sized so that the main jet that is formed contains up to eighty-five percent of the fuel gas from the fuel gas source.

11. A burner according to claim 1, wherein:

each hole of said bluff-body is sized to let pass through about one third of the fuel gas exiting from the corresponding outlet of the adjacent auxiliary feed pipe.

12. A burner according to claim 1 which is enclosed in a conduit.

* * * * *